United States Patent [19]

Tuley

[11] 3,970,318

[45] July 20, 1976

[54] SEALING MEANS FOR A SEGMENTED RING

[75] Inventor: Eugene N. Tuley, Hamilton, Ohio

[73] Assignee: General Electric Company, Cincinnati, Ohio

[22] Filed: Sept. 26, 1975

[21] Appl. No.: 617,072

[52] U.S. Cl. ..... 277/26; 415/172 R; 415/217

[51] Int. Cl.[2] ..... F01D 1/02; F01D 9/00; F16J 9/16

[58] Field of Search ..... 277/29; 415/217, 136, 415/172, 174

[56] References Cited

UNITED STATES PATENTS

| | | | |
|---|---|---|---|
| 3,690,785 | 9/1972 | Lind | 277/26 |
| 3,728,041 | 4/1973 | Bertelson | 415/217 |
| 3,752,598 | 8/1973 | Bowers et al. | 415/217 |
| 3,752,599 | 8/1973 | Pace | 415/217 |

*Primary Examiner*—Robert I. Smith
*Attorney, Agent, or Firm*—Henry J. Policinski; Derek P. Lawrence

[57] ABSTRACT

In a segmented cylindrical flow confining apparatus, fluidic sealing is provided between the segments of the apparatus. Adjacent segments include flanges in overlapped radially spaced relationship to form a gap therebetween. A seal member resides in a pair of overlapping pockets formed in the overlapping flanges. The seal member is in sealing engagement with the end wall of each pocket and is free to rotate from a first sealing position to a second sealing position when the flow confining apparatus is subject to thermally induced growth.

6 Claims, 5 Drawing Figures

SEALING MEANS FOR A SEGMENTED RING

The invention herein described was made in the course of or under a contract, or a subcontract thereunder, with the U.S. Department of the Air Force.

BACKGROUND OF THE INVENTION

This invention relates to a fluidic seal for use in a gas turbine engine and, more particularly, to a fluidic seal between arcuate segments of the stator-nozzle assembly.

In large turbojet and turboshaft engines, the nozzle-turbine section is of relatively complex construction. For example, the nozzle diaphragm is comprised of a plurality of circumferentially spaced airfoils extending radially inward from an outer circumferentially annular band. More particularly, the nozzle diaphragm is formed of a series of arcuate nozzle diaphragm segments joined together each including a band portion and a plurality of airfoils. This type of construction usually requires a number of closely machined mating surfaces between nozzle diaphragm segments and sealing means to deployment between the surfaces.

Conventional seals have long been employed between adjacent arcuate nozzle segments. These conventional seals can all be characterized as tangential seals since they extend in a tangential or circumferential direction to seal a tangential or circumferential gap between adjacent nozzle diaphragm segments. Various problems arise with seals employed in this manner. First, thermal growth of the arcuate sections of the nozzle diaphragms is greatest in the circumferential direction. Hence, the gap across which the seal is disposed is widely variable in dependence upon the temperature of the nozzle segments. In order to be effective a seal must be relatively insensitive to variations in gap width which occur with variations in temperature. While prior art seals have approached this problem by providing free-standing seals which reside in an oversized slot and which are designed to extend fully across the gap at its maximum width, such seals have exhibited excessive fluid leakage over the wide range of pressure drops typically encountered by the seal. The excessive leakage results, in part, from resonant vibration of the free-standing seal which causes the seal to lift from its sealing surface.

Another difficulty encountered arises from practical constraints associated with assembly of the nozzle diaphragm into the turbine section. In many instances assembly of adjacent nozzle segments cannot be accomplished by axial insertion since adjoining portions of the turbine structure restricts axial access. While previous attempts have been made to provide a sealing structure which would be compatible with radial insertion, such attempts have not proven to be completely commercially satisfactory because of the intricacy of the design and its associated excessive cost. One such attempt, shown in U.S. Pat. No. 3,728,041 discloses angled cavities in each segment inclined to the segment surface at an angle not less than the angle of intersection of the plane of insertion of the adjacent segment.

Therefore, it is an object of this invention to provide a sealing arrangement between the interfaces of a segmented nozzle diaphragm wherein the effectiveness of the sealing member is relatively insensitive to the arcuate thermal growth of the arcuate nozzle-diaphragm segments.

It is another object of this invention to provide such a sealing arrangement that is effective to prohibit fluid leakage over the wide range of pressure drops typically encountered in the turbine nozzle section of a gas turbine engine.

It is yet another object of the present invention to provide an inexpensive sealing arrangement which is easily compatible with assembly constraints associated with the turbine section of a gas turbine engine.

SUMMARY OF THE INVENTION

These and other objects, which will become apparent from the following specification and appended drawings, are accomplished by the present invention which provides for a radially extending seal member disposed within a radial gap between adjacent overlapping flanges of adjacent nozzle segments. More particularly, first and second overlapping pockets opening into the gap are disposed in first and second overlapping spaced flanges respectively. Each pocket has a radial end wall opposite the opening of the pocket. A seal member resides in each of the first and second pockets and extends radially across the gap. The seal engages a first portion of each end wall to effect sealing engagement therewith. The second pocket is movable from a first overlapping position relative to the first pocket to a second overlapping position therewith and the seal is rotatable to engage a second portion of each of the end walls. The seal member is comprised of a radial height greater than the predetermined height of a radial space separating end walls associated with each pocket. A first pair of radially extending and circumferentially facing side walls associated with the first pocket are separated from each other by a circumferential distance which is substantially greater than the circumferential thickness of the seal member.

DESCRIPTION OF THE DRAWINGS

While the specification concludes with claims distinctly claiming and particularly pointing out the invention described herein, it is believed that the invention will be more readily understood by reference to the discussion below and the accompanying drawings in which:

DESCRIPTION OF THE PREFERRED EMBODIMENT

Figure 1:
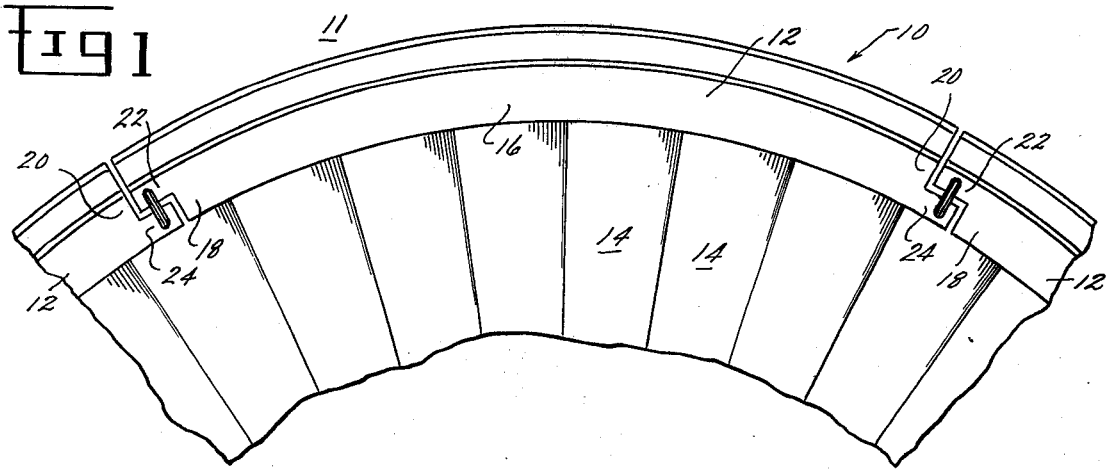
FIG. 1 is a front view showing a portion of a segmented nozzle diaphragm having a fluid seal arrangement in accordance with the present invention.

Referring to FIG. 1, a portion of a nozzle diaphragm with a sealing arrangement in accordance with the present invention is shown. The segmented nozzle diaphragm 10 includes a plurality of individual arcuate segments 12 circumferentially adjacent one another for form an annular ring, a portion of which is shown. A plenum of cooling air 11 flows axially past nozzle diaphragm segment radially outward thereof. Airfoils 14 integrally attached to ring segment 16 project radially inwardly therefrom. Airfoils 14 serve to direct hot gases flowing axially along and radially inwardly of ring segment 16 at the appropriate angle and velocity upon the turbine blades of the turbine section (not shown).

Each ring segment 16 includes end portions 18 and 20 disposed at its opposite arcuate ends. Flanges 22 and 24 extend circumferentially from end portions 18 and 20 respectively. Each flange 22 and 24 is disposed in a lapped relationship with the flanges of the next circumferentially adjacent nozzle segment 12. More particularly, flange 22 of any individual nozzle segment 12 overlaps flange 24 of the next circumferentially adjacent nozzle segment 12. Furthermore, each flange 24 of the same individual nozzle segment 12 underlaps flange 22 of the next circumferentially adjacent nozzle segment 12.

Figure 2:
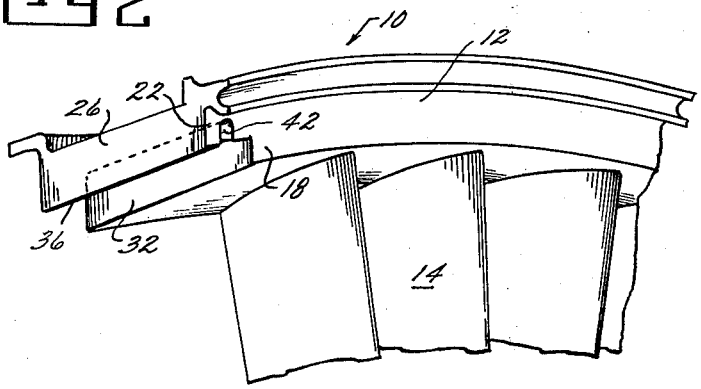
FIG. 2 is a perspective view showing a portion of a nozzle diaphragm segment configured in accordance with the present invention.

Referring now to FIG. 2, a perspective view showing the axial depth of nozzle segment 12 is presented. A pocket 42 is formed, for purposes hereinafter to be described, in flange 22. Pocket 42 extends across the entire axial width of nozzle segment 12.

Figure 3:
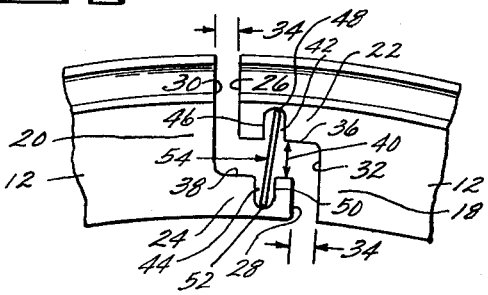
FIG. 3 is an enlarged view of the sealing arrangement comprising the present invention shown when the nozzle diaphragm is not subject to conditions inducing thermal growth of the assembly.

Referring now to FIG. 3, an enlarged view exhibiting the overlapped relationship between the respective flanges 22 and 24 of adjacent flanges when the nozzle diaphragm 10 is not subject to conditions promoting thermal growth is depicted.

Circumferentially facing end surface 26 is disposed at the arcuate end of flange 22 and similarly a circumferentially oppositely facing end surface 28 is disposed at the arcuate end of flange 24. Circumferentially facing end surface 30 formed at the arcuate end of end portion 20 confronts and is circumferentially spaced from end surface 26. Similarly circumferentially facing end surface 32 formed at the arcuate end of end portion 18 confronts and is circumferentially spaced from end surface 28. End surface 26 is circumferentially spaced from end surface 30 so as to form a circumferential gap 34 therebetween. Circumferential gap 34 is also formed between confronting surfaces 28 and 32. While gap 34 between confronting end surfaces 26 and 30 need not be of the same circumferential width as the gap between confronting end surfaces 28 and 32, for purposes of illustrating the present invention, the gap between each of these confronting surfaces is shown to be of equal width.

Radially inwardly facing ledge 36 is interposed between circumferentially facing surfaces 26 and 32 and is radially spaced from a radially outwardly facing ledge 38 interposed between circumferentially facing surfaces 28 and 30. Radially facing ledges 36 and 38 are radially spaced from each other to form a radial gap 40 therebetween.

Opposed and at least partially overlapping pockets 42 and 44 are arranged within end flanges 22 and 24 respectively so as to open into radially facing ledges 36 and 38 respectively. Pocket 42 is comprised of a pair of radially extending and circumferentially facing side walls 46, each of which terminates at curved radial end wall 48 disposed at their radially outward ends. Similarly pocket 44 is comprised of a pair of radially extending and circumferentially facing side walls 50, each of which terminate at curved radial end wall 52 disposed at their radially inward ends. Both pockets extend axially across the entire axial length of their respective nozzle diaphragm segments 12. As shown in FIG. 3, pockets 42 and 44 are at least in partial overlapping relationship with each other and are radially separated by radial gap 40. End wall 48 and end wall 52 are separated from each other by a radial space of predetermined radial height when pockets 42 and 44 are in overlapped relationship.

Figure 4:
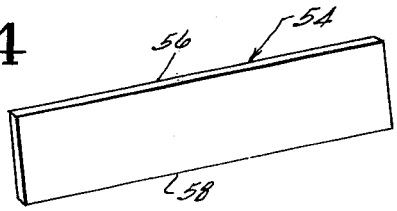
FIG. 4 is an enlarged perspective view of the seal member included in the present invention.

Referring now to FIGS. 3 and 4, seal member 54 is disposed within pockets 42 and 44 and is comprised generally of a rectangularly configurated shim-like metallic material. Seal member 54 has an axial length generally coextensive with the axial length of pockets 42 and 44 and hence with the axial length of nozzle diaphragm segment 12. The radial height of seal member 54 is slightly greater than the predetermined radial height separating end wall 48 from end wall 52. Seal member 54 includes two radially facing sealing surfaces 56 and 58 (shown in FIG. 4) one of which is in sealing engagement with end wall 48 and the other of which is in engagement with end wall 52. With these surfaces in sealing engagement seal 54 obstructs the flow of gases and cooling air through radial gap 40. Cooling air from plenum 11 which may enter the gap 34 between surfaces 30 and 26 cannot pass beyond seal 54. Similarly hot gases which may enter the gap 34 between confronting surfaces 28 and 32 cannot pass beyond seal 54. It should be pointed out that the pressure of the cooling air is greater than the pressure of the hot gases and hence the seal member is biased to the right as viewed in FIG. 3.

Figure 5:
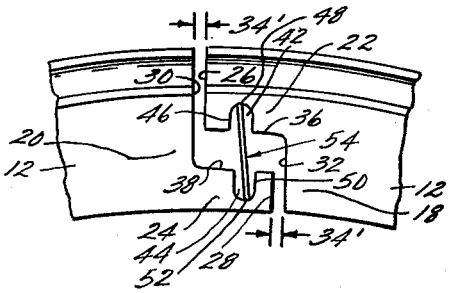
FIG. 5 is an enlarged view of the sealing arrangement comprising the present invention shown when the nozzle diaphragm is subject to conditions inducing thermal growth of the assembly.

Referring now to FIG. 5, portions of two adjacent nozzle diaphragm arcuate segments are shown under conditions of high operating temperature. The high temperatures associated with the hot gases flowing against blade segments 14 result in circumferential expansion of arcuate segments 12 with the result that gap 34' now exists between end surfaces 26 and 30 and between end surfaces 28 and 34. Due to thermally induced circumferential growth of arcuate segments 12 gap 34' is of lesser magnitude than gap 34. While the arcuate segments 12 may also expand radially such expansion is much less than the aforementioned circumferential expansion since the thickness of arcuate segment 12 is much less in the radial direction than in the circumferential direction.

Circumferential expansion of arcuate segment 12 causes flanges 22 and 24 of adjacent segments 12 to increase the degree of their common overlap. Hence, the circumferential position of pocket 42 in flange 22 relative to pocket 44 in flange 24 is modified. More particularly, pockets 42 and 44 move circumferentially from a first relative position to a second relative position. Movement of the pockets 42 and 44 in this manner cause seal 54 to rotate about its longitudinal axis from a first position whereby it is in engagement with a first portion of end walls 48 and 52 of pockets 42 and 44 to a second position whereby it is in engagement with a second portion of end walls 48 and 52. Such rotation is accomplished while maintaining radial facing sealing surfaces in engagement with end walls 48 and 52. It is of significant import that the pair of side walls 46 are separated from each other by a circumferential distance substantially greater than the circumferential thickness of seal member 54. Hence the pair of side walls 46 do not interfere with or obstruct rotation of seal member 54. Side walls 50 are similarly constructed for the same purpose.

The aforedescribed present invention provides a significant improvement over prior art devices which were comprised of tangentially disposed seals; that is, seals bridging a circumferential or tangential gap. Such seals were unduly sensitive to circumferential expansion of the arcuate nozzle diaphragm segments since the gap across which the seal extended was subject to excessive changes in width. Hence, the seal was designed such that it either compressed during circumferential growth which results in premature failure of the seal, or such that it was free-standing and exhibited excess leakage due to resonance. In the present invention seal 54 is disposed such that it is relatively insensitive to circumferential expansion. In the aforedescribed embodiment of the present invention, thermally induced circumferential growth of adjacent arcuate segments 12 causes seal member 54 to merely rotate from a first to a second position. Seal member 54 is not compressed to any significant degree and is maintained in engagement with end walls 48 and 52 hence avoiding any leakage problems associated with resonance.

While the preferred embodiment of my invention has been described fully in order to explain its principles, it is to be understood that modifications of the structure may be made within the spirit of my invention and that it is not to be regarded as being limited to the exact details of the description. but may be utilized in other ways without departing from the scope of the invention as defined by the following claims:

I claim:

1. In a circumferentially segmented cylindrical flow confining apparatus, a fluidic seal arrangement between circumferential adjacent arcuate segments comprising:

a first circumferentially extending flange portion associated with one of said arcuate segments a second circumferentially extending flange portion associated with an adjacent one of said arcuate segments, said second flange portion disposed radially outwardly and in overlapping spaced relationship with respect to said first flange portion so as to form a radial gap therebetween;

a first pocket in said first flange portion opening into said radial gap, said first pocket having a first radial end wall opposite said opening;

a second pocket in said second flange portion opening into said radial gap, said second pocket having a second radial end wall opposite said opening, said second pocket disposed radially outwardly and in a first overlapping spaced position with said first pocket, a radially extending seal member residing in each of said first and second pockets and extending radially across said gap, said seal member having a first position for sealing engagement with a first portion of each of said first and second radial end walls.

2. The invention as set forth in claim 1 wherein said second pocket is circumferentially movable in response to thermally induced growth of said second arcuate segment to a second overlapping spaced position with said first pocket, and said seal member is rotatable to a second position for sealing engagement with said first and second radial end walls.

3. The invention as set forth in claim 2 wherein said seal member is in sealing engagement with a second portion of said first and second radial end walls when said seal member is in said second position.

4. The invention as set forth in claim 1 wherein said first radial end wall and said second radial end wall are separated from each other by a radial space of predetermined radial height when said first and second pockets are in said overlapping spaced position and said seal member is comprised of a radial height greater than predetermined height.

5. The invention as set forth in claim 4 wherein said first pocket is comprised of first pair of radially extending and circumferentially facing side walls, each side wall being separated from the other by a circumferential distance, said seal member being further comprised of a predetermined circumferential thickness, said circumferential distance being substantially greater than said predetermined circumferential thickness.

6. The invention as set forth in claim 4 wherein said second pocket is comprised of a second pair of side walls, each side wall being separate from the other by a circumferential distance, said seal member being further comprised of a predetermined circumferential thickness, said circumferential distance being substantially greater than said predetermined circumferential thickness.

* * * * *